United States Patent [19]

Dilcher

[11] Patent Number: 4,924,625

[45] Date of Patent: May 15, 1990

[54] SWINGING AND SLIDING DOOR FOR ROLLING STOCK

[75] Inventor: Dietmar Dilcher, Vellmar-West, Fed. Rep. of Germany

[73] Assignee: Gebr. Bode & Co. GmbH, Kassel, Fed. Rep. of Germany

[21] Appl. No.: 281,113

[22] Filed: Dec. 7, 1988

[30] Foreign Application Priority Data

Dec. 12, 1987 [DE] Fed. Rep. of Germany ..... 3742279

[51] Int. Cl.[5] ..... E05D 15/10

[52] U.S. Cl. ..... 49/212; 49/216; 49/220

[58] Field of Search ..... 49/212, 213, 215, 218, 49/219, 220, 209, 221

[56] References Cited

U.S. PATENT DOCUMENTS

| | | | |
|---|---|---|---|
| 3,413,758 | 12/1968 | Palsson | 49/220 |
| 4,495,729 | 1/1985 | Britzke et al. | 49/212 |
| 4,617,756 | 11/1986 | Dilcher | 49/215 |
| 4,669,220 | 6/1987 | Dilcher | 49/219 |

FOREIGN PATENT DOCUMENTS

| | | | |
|---|---|---|---|
| 696812 | 8/1940 | Fed. Rep. of Germany | 49/216 |
| 2125870 | 3/1984 | United Kingdom | 49/220 |

*Primary Examiner*—Kenneth J. Dorner
*Assistant Examiner*—Gerald A. Anderson
*Attorney, Agent, or Firm*—Sprung Horn Kramer & Woods

[57] ABSTRACT

A swinging and sliding door for rolling stock, especially a car that rides on a track, in mass transit. The panel of the door slides along a guide that pivots across the plane of the door on two cranks with vertical axes. The door has a system of articulations that will ensure a sufficient angle on the part of the door panel as the door begins to open even when the cranks are relatively short. The cranks, a rigid coupling that has the guide mounted on it and connects the cranks, and crank journals that are rigidly secured to the door frame form a four-member articulation, with the cranks rotating in opposite directions.

10 Claims, 6 Drawing Sheets

SWINGING AND SLIDING DOOR FOR ROLLING STOCK

BACKGROUND OF THE INVENTION

The invention concerns a swinging and sliding door for rolling stock, especially a car that rides on a track, in mass transit, whereby the panel of the door slides along a guide that pivots across the plane of the door on two cranks with vertical axes.

Various embodiments of swinging and sliding doors are known. Common to all of them is that the panel of the door slides along a guide that pivots across the plane of the door on two cranks with vertical axes. The known embodiments include swinging and sliding doors wherein the cranks pivot around a common horizontal axis and those wherein they pivot around vertical axes. In the latter embodiment it is desirable for the panel itself to also rotate slightly around a vertical axis as the door begins to open to allow the exiting edge of the panel to leave the door frame simultaneously with the beginning of the opening motion and hence to begin sliding. Attempts have been made to attain this goal by using cranks of different lengths, whereby, however, the lines that connect the limiting positions of the cranks must remain parallel with the starting position so that the panel will again parallel its closed position or the outer surface of the body of the car once it has rotated out. The angle of the panel that can be attained in this way, however, is slight because it is very difficult to install cranks of different lengths.

SUMMARY OF THE INVENTION

The object of the invention is to provide a swinging and sliding door of the aforesaid type with a system of articulations that will ensure a sufficient angle on the part of the door panel as the door begins to open even when the cranks are relatively short.

This object is attained in accordance with the invention by the improvement wherein the cranks, a rigid coupling that has the guide mounted on it and connects the cranks, and crank journals that are rigidly secured to the door frame form a four-member articulation, with the cranks rotating in opposite directions.

The stroke h generated by a rotating crank is represented by the equation $h=r(1-\cos\alpha)$, wherein r is the length of the arm of the crank and $\alpha$ the angle between the crank and the direction of the stroke. Using cranks that rotate in opposite directions, with different initial positions, and with the motions connected by the coupling makes it possible for the stroke generated by one crank to anticipate the stroke generated by the other, positioning the coupling at an angle to its initial position during the motion.

The result is that, since the panel is initially positioned at an angle during the stroke, the leading edge of the panel will be lifted out of the plane of the door frame as it opens, whereas, once the stroke is complete, the panel will again parallel its closed position or the outer surface of the body.

The cranks in one especially simple embodiment of the swinging and sliding door in accordance with the invention are of equal length. In this case, the terminal position of one crank will parallel the initial position of the other.

The sliding motion of the panel is coordinated with its swinging motion by means of a guide roller that is secured stationary to the panel and travels back and forth in a guide rail secured to the door frame.

It is practical for the bottom of the panel to travel back and forth in another guide rail.

One embodiment of the invention will now be specified with reference to the drawings, wherein

BRIEF OF THE DRAWINGS

FIG. 1 is a view from inside of a swinging and sliding door in accordance with the invention, FIG. 2 is a view of the same door along the direction that it slides in, FIG. 3 is a larger-scale view of the section demarcated by the dot-and-dash circle at the top of FIG. 2, FIG. 4 is a view of the door from the top, in the direction represented by arrow Y, with the continuous lines showing it closed andthe dot-and-dash lines showing it open, FIG. 5 is a view similar to that in FIG. 4, with the continuous lines showing the door closed and the dot-and-dash lines showing it with the panel at the maximal angle it assume s while opening, and FIG. 6 is a view similar to that in FIG. 4 of a variation of the embodiment illustrated in FIGS. 1 through 5.

DETAILED DESCRIPTION OF THE INVENTION

Figure 1:
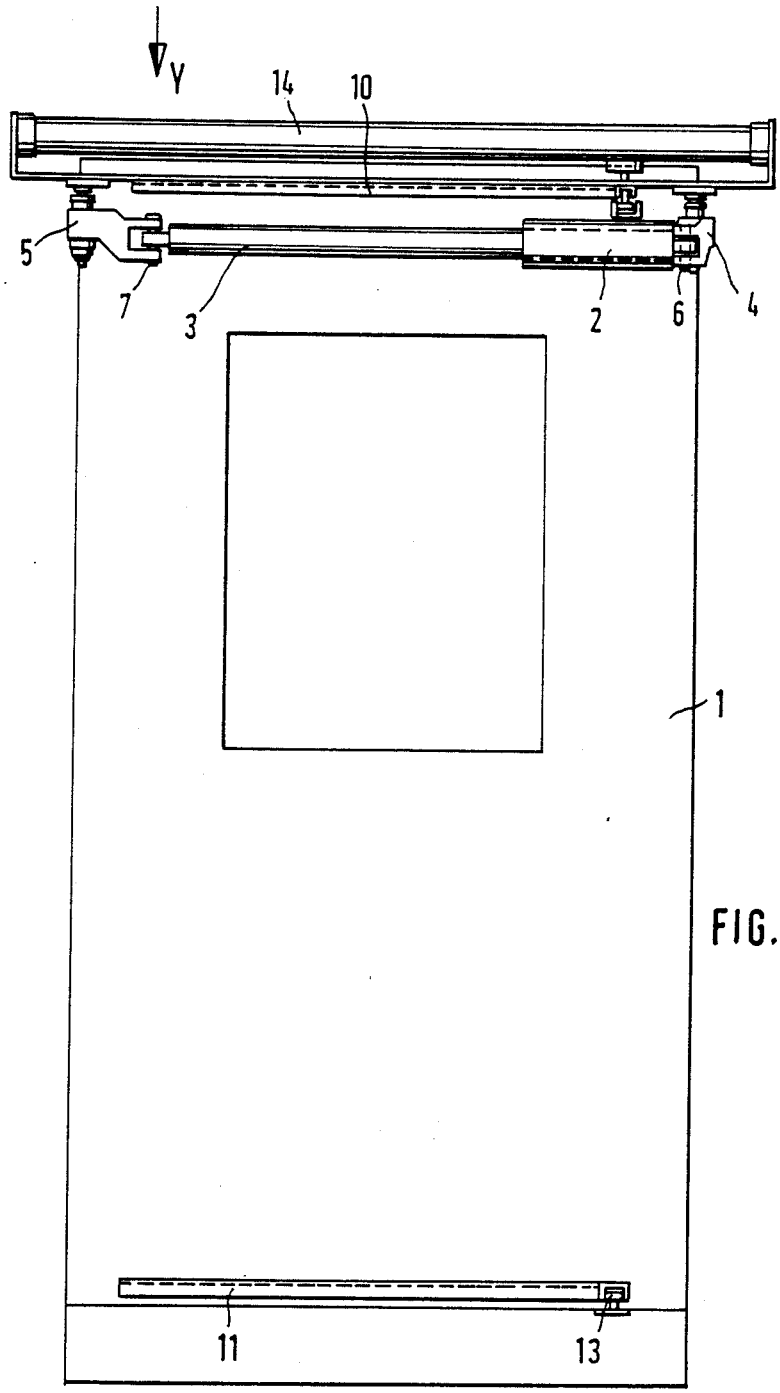
Figure 2:
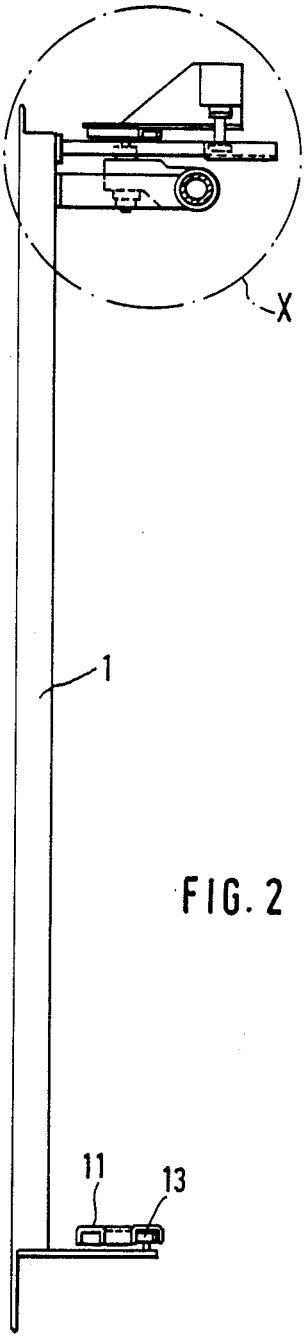
Figure 3:
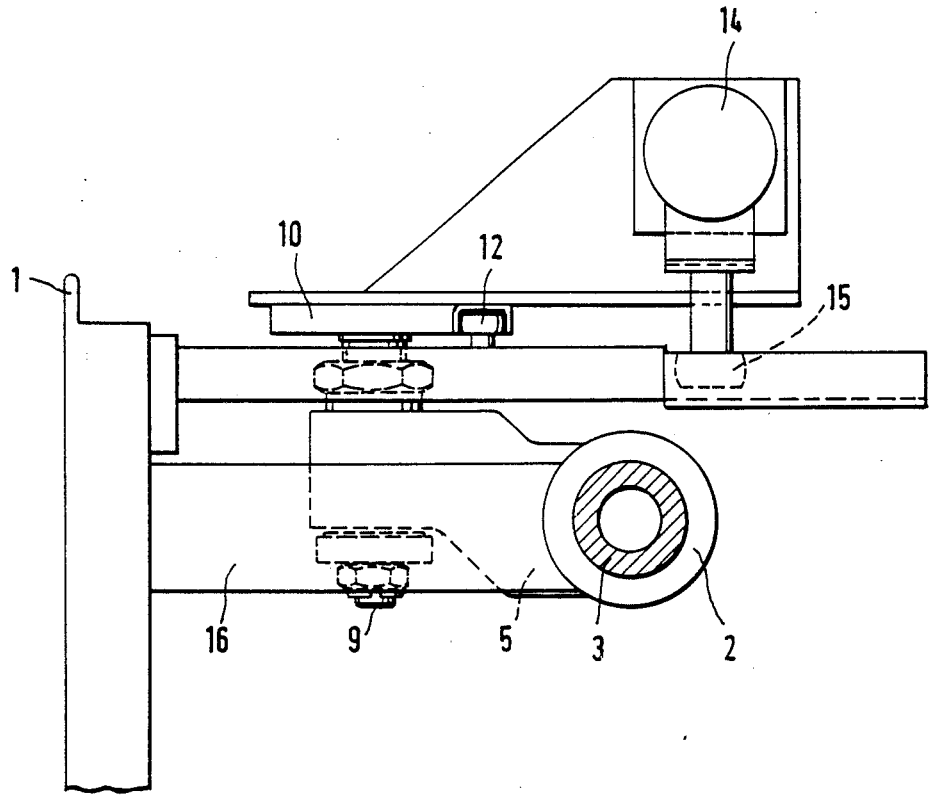

Referring now to FIGS. 1–5, the panel 1 of the swinging and sliding door illustrated in FIG. 1 is attached by a non-rotating arm 16 to a cylindrical sleeve 2 that constitutes a support and travels along a supporting rail in the form of a guide consisting of a round rod 3. The guide and the support that travels along it can also be of any other design known in relation to swinging and sliding doors. One end of the rod 3 is connected to a crank 4 by a bolt 6 and the other end to a crank 5 by a bolt 7. Cranks 4 and 5 rotate on journals 8 and 9 on a door frame 17 that is only schematically illustrated. As will be apparent from FIGS. 4 and 5, crank 4 rotates to the right as the door opens and crank 5 rotates to the left. Since the cranks are rigidly connected by rod 3 and since journals 8 and 9 are rigidly secured to the door frame, cranks 4 and 5, rod 3, and door frame 17 constitute a four-member articulation, with the cranks rotating in opposite directions. The conditions in which the cranks can rotate in opposite directions (cf. FIG. 4) are $\alpha 1E<90°$ and $\alpha 2A>90°$, with the direction h of the stroke acting as the 0° leg of the angle (cf. also FIGS. 5 & 6). The conditions in which the initial and terminal positions of the rod 3 that constitutes the coupling will be parallel when cranks 4 and 5 are of equal length are $\alpha 1A=180° -\alpha 2E$ and $\alpha 1E=180° -\alpha 2A$. As the door begins opening, the center of momentum for the motion of rod 3 is at point M (cf. FIG. 4). It will accordingly be evident that rod 3 and hence panel 1 will immediately be positioned at an angle. The maximal angle will be attained when cranks 4 and 5 are parallel ($\alpha 1$max and $\alpha 2$max in FIG. 5).

Figure 4:
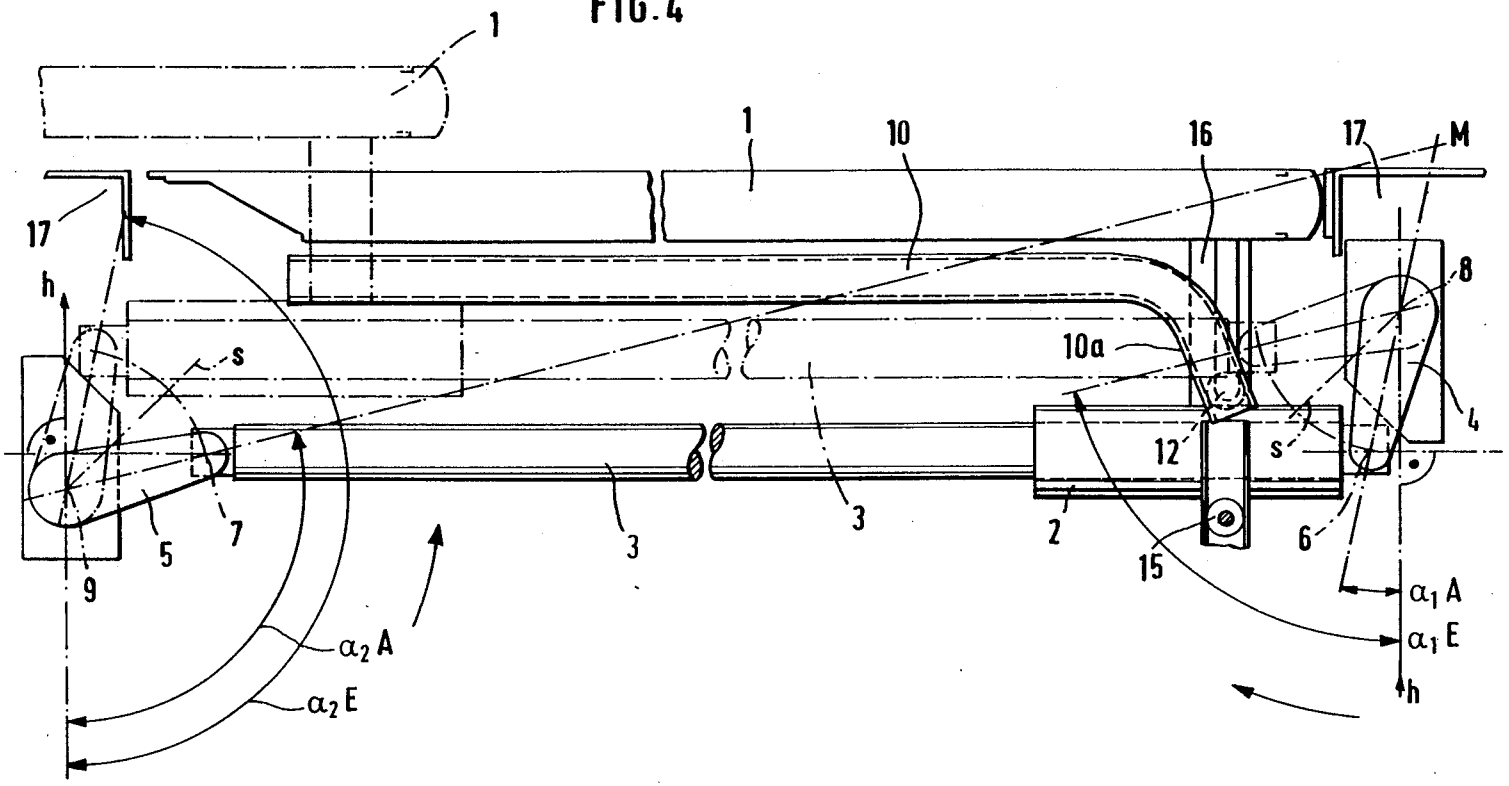

The sliding and swinging are coordinated, as will be evident from FIG. 4, by a guide rail 10 that is secured to door frame 17 and has a guide roller 12 traveling back and forth in it and mounted on non-rotating arm 16.

Figure 5:
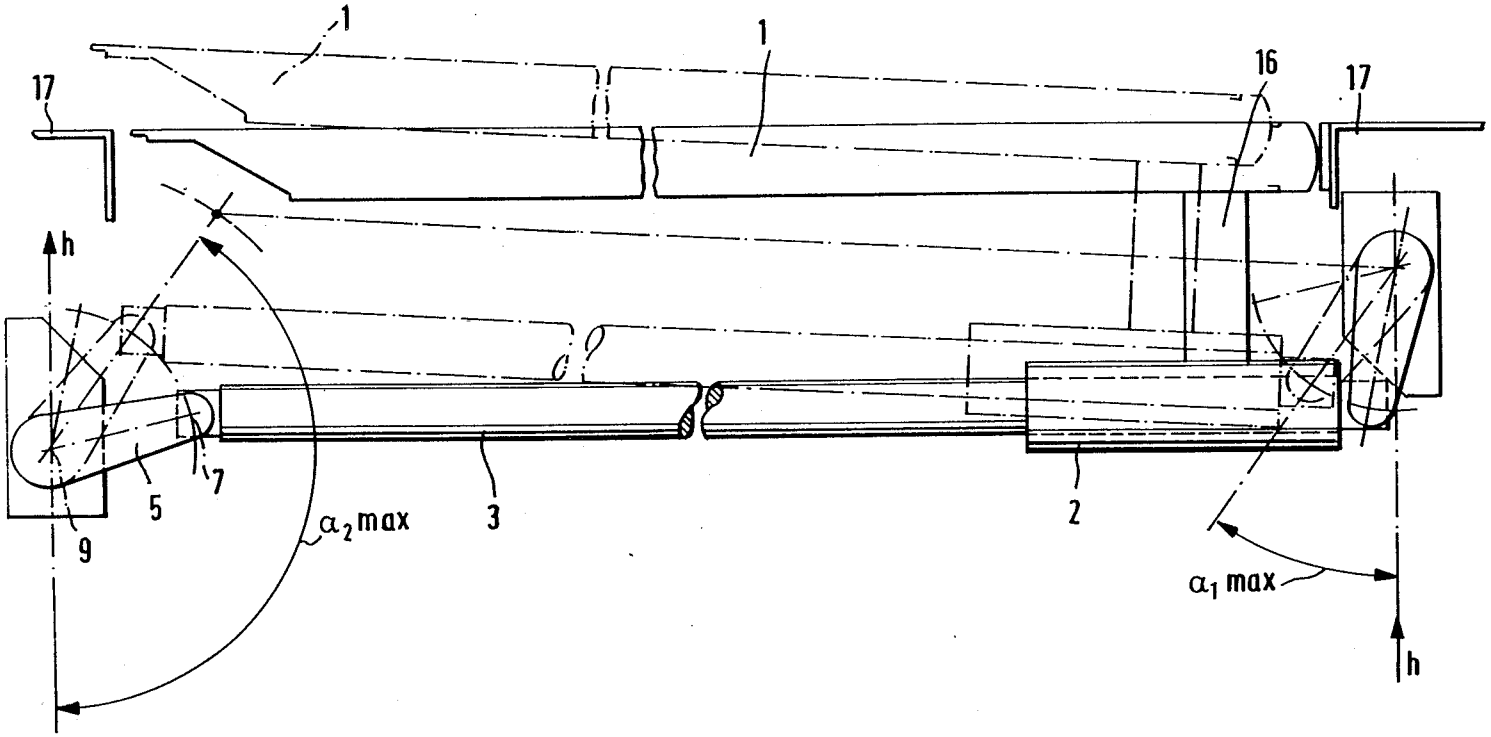

The swinging and sliding door can be driven by any drive mechanism known in the context of sliding doors. The drive mechanism in the instant embodiment is a belt cylinder that moves the door toward the left in FIGS. 4 and 5 by way of a pulley 15. As soon, however, as this mechanism begins to force sleeve 2 to the left, the initial section 10*a* of guide rail 10, the section that points in toward the inside of the car, forces guide roller 12 outward and accordingly induces a rotation on the part of crank 4, with the crank 5 that is connected to it by rod 3 simultaneously rotating. As will be evident from FIG. 5, wherein guide rail 10 is not represented, even a short linear displacement of sleeve 2 along rod 3 causes crank 5 to execute a powerful stroke, accordingly lifting the edge of panel 1 that leads as the door opens, out of door frame 17 as illustrated in FIG. 5, so that the sliding motion can commence without being impeded by the frame. Since, as will be evident from FIG. 4, the strokes traveled by each crank 4 and 5 are again equal upon termination of their rotation, panel 1 will be displaced along the wall of the car parallel to its position when closed. The bottom edge of the panel is guided inside another guide rail 11 by another guide roller 13. Guide rail 11, like upper guide rail 10, is angled such that, as the door begins to open, its bottom will also be lifted out of the door frame.

The journals 8 and 9 for cranks 4 and 5 can be positioned anywhere on the plane s of symmetry between the initial and terminal position of bolts 6 and 7.

Figure 6:
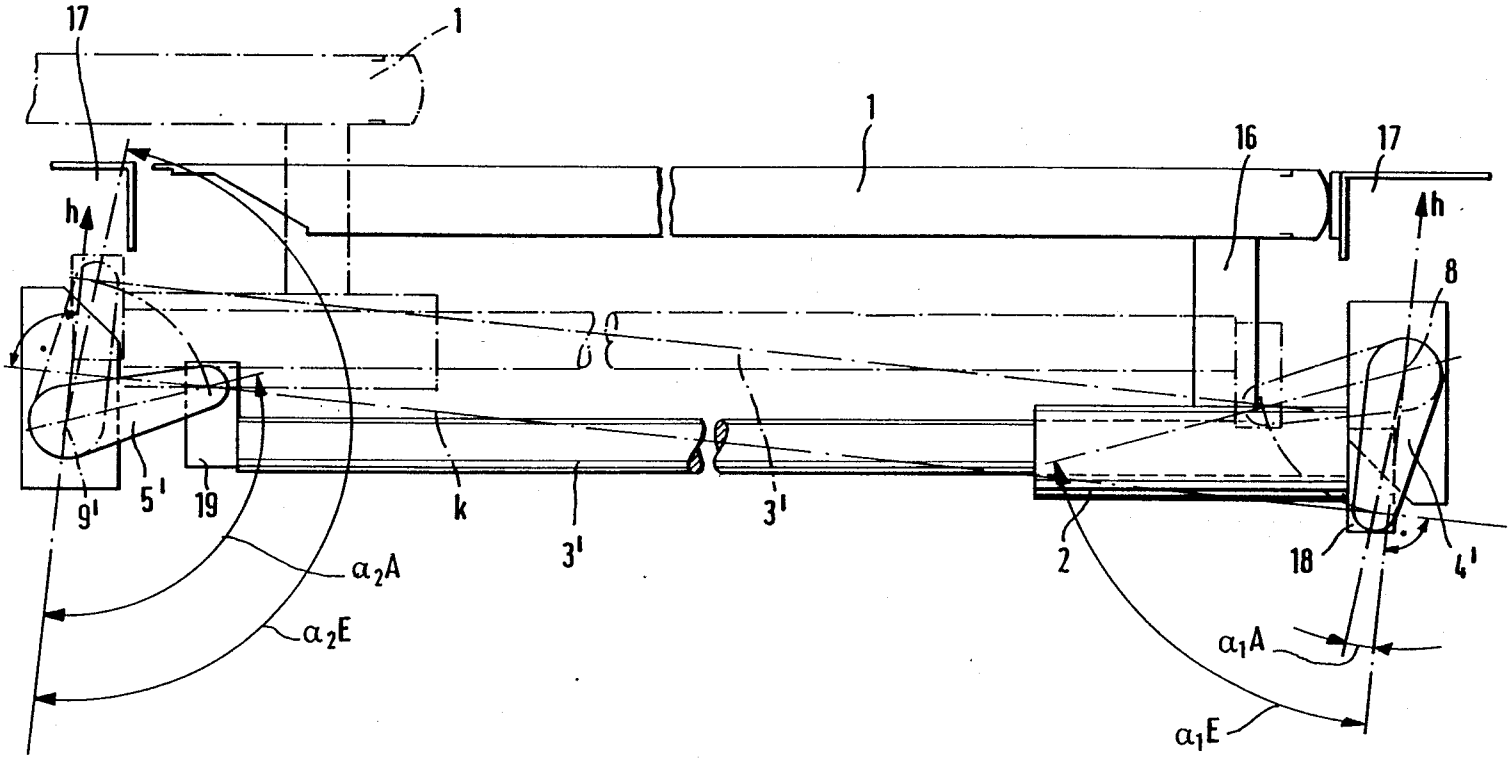

The coupling between cranks 4 and 5 in the embodiment illustrated in FIGS. 1 through 5 consists of rod 3, and its orientation coincides with the longitudinal midline of the rod. This design, however, is by no means compulsory, and FIG. 6 illustrates a variant wherein the ends of cranks 4' and 5' are connected by a coupling that consists of a rod 3', each end of which is connected to one end of a crank by connectors 18 and 19 that extend across the longitudinal midline of the rod. The orientation of coupling k in this embodiment does not coincide with the longitudinal midline of rod 3' but is at an angle to it.

As the door closes, the processes reverse, with the cranks remaining in the open position throughout most of the closing motion and not beginning to rotate until guide roller 12 arrives at the angled section 10*a* of guide rail 10, upon which they retract the door into the closed position, in which it is in the same plane as the outer surface of the car.

Although FIG. 1 illustrates the swinging and sliding door as flat, it can of course curve or bend in at the bottom to conform with the outer surface of the car.

Some cars have entrances and exits at the ends and an outer surface that tapers slightly toward the ends. The open position of a swinging and sliding door on a car of this type should parallel not its closed position but the wall of the car. This situation can be attained in a door of the aforesaid type if the line that connects the terminal positions of the two cranks comes to rest not parallel to but at an angle to the line that connects their initial position.

What is claimed is:

1. In a swinging and sliding door for rolling stock, having a frame, a panel, a guide along which the panel slides and means for pivoting the guide across the plane of the door including two cranks with vertical axes, the improvement wherein the means for pivoting the guide further comprises means coupling the cranks to form a four member articulation with the frame wherein the cranks rotate in opposite directions including a rigid coupling on which the guide is mounted and connecting the cranks, and wherein the cranks have crank journals rigidly secured to the door frame.

2. The swinging and sliding door as in claim 1, wherein the pivoting means further comprises means for coordinating the sliding motion of the panel with its swinging motion comprising a guide roller in a guide rail secured to the door frame.

3. The swinging and sliding door as in claim 1 or 2, wherein the terminal positions of the coupling are parallel.

4. The swinging and sliding door as in claim 1, wherein the cranks are of equal length.

5. The swinging and sliding door as in claim 1, wherein the position of the closed panel demarcates the motion of the cranks and coupling means while the door is closing.

6. The swinging and sliding door as in claim 2, wherein the guide rail demarcates the terminal position of the panel at the conclusion of the swing as the door opens and thereby the terminal positions of the cranks and of the coupling means in the opening direction.

7. The swinging and sliding door as in claim 2, wherein a bottom edge of the panel is positioned in second guide rail by a second guide roller.

8. The swinging and sliding door as in claim 7, wherein the guide rails have an initial section that extends at an angle to the plane of the closed door and another section that substantially parallels an outer surface of the car.

9. The swinging and sliding door as in claim 1, wherein the coupling means in the four-member articulation comprises a portion of the guide.

10. The swinging and sliding door as in claim 9, wherein the coupling means comprises a round rod supporting rail surrounded by a cylindrical sleeve support that slides back and forth along the rail and is rigidly secured to the panel by a nonrotating arm.

* * * * *